US005308127A

United States Patent [19]

Foster

[11] Patent Number: 5,308,127

[45] Date of Patent: May 3, 1994

[54] METHOD FOR LOCKING A SASH

[76] Inventor: Michael J. Foster, Brigown, St. Philomena's Road, Crosshaven County Cork, Ireland

[21] Appl. No.: 4,317

[22] Filed: Jan. 14, 1993

[51] Int. Cl.[5] ..... E05C 1/14

[52] U.S. Cl. ..... 292/175; 292/153; 29/437

[58] Field of Search ..... 292/60, 150, 153, 175, 292/290, 304; 29/437

[56] References Cited

U.S. PATENT DOCUMENTS

| | | | |
|---|---|---|---|
| 257,722 | 5/1882 | Kempshall | 292/175 |
| 595,290 | 12/1897 | Dowman | 292/150 |
| 672,439 | 4/1901 | Burson | 292/290 |
| 876,429 | 1/1908 | Bleyer | 292/153 |
| 1,490,221 | 4/1924 | Lynn | 292/153 |
| 1,650,454 | 11/1927 | Langan | 292/304 X |
| 1,714,196 | 5/1929 | Vara | 292/60 |
| 1,892,613 | 12/1932 | Edgin | 292/304 |
| 2,657,086 | 10/1953 | Sweet | 292/175 |

*Primary Examiner*—Richard E. Moore
*Attorney, Agent, or Firm*—Vidas, Arrett & Steinkraus

[57] ABSTRACT

A method is for selectively locking two frame members of a window or door to prevent sliding movement of one frame relative to the other. The method involves providing an aperture in one frame, securing a sleeve to the other frame in alignment with the aperture, inserting a bolt through the sleeve and into the aperture. The bolt includes two lengths which are pivotably connected together. When the bolt is in retracted position, one portion of the bolt can be pivoted relative to the other portion of the bolt and then moved along a line perpendicular to the axis of the first portion of the bolt.

4 Claims, 3 Drawing Sheets

METHOD FOR LOCKING A SASH

CROSS REFERENCE TO RELATED APPLICATIONS

Copending application Ser. No. 08/004,282, filed Jan. 14, 1993 and directed to a Sash Locking System.

FIELD OF THE INVENTION

This invention relates to locking or fastening methods and systems for sashes on windows or doors. More particularly, this invention relates to fastening methods for selectively locking sashes on windows or doors.

BACKGROUND OF THE INVENTION

A variety of devices and systems have been used for locking or fastening sashes on windows and doors. See, for example, U.S. Pat. Nos. 47,537; 184,501; 532,935; 1,992,531; 2,018,346; 2,076,897; 2,098,249; 2,357,608; 2,845,789; and 3,082,617. Although some of such fastening systems involve the use of a movable bolt for preventing relative movement of one frame member relative to another frame member, such fastening systems exhibit a number of disadvantages and have not been entirely satisfactory.

Additional fastening systems are described, for example, in U.S. Pat. Nos. 8,286; 357,116; 876,429; 972,769; 985,652; 1,352,624; 1,509,619; 2,657,086; 2,477,524; and 3,233,932. These patents describe fastening systems involving movable bolts, some of which can be locked in a retracted position. However, the fastening systems described therein are cumbersome in use or require specialized hardware.

There has not heretofore been provided a locking method having the advantages and exhibiting the ease of use which are associated with the locking method of this invention.

SUMMARY OF THE PRESENT INVENTION

In accordance with the present invention there is provided an improved locking method for selectively locking first and second frame members of a window or door to prevent sliding movement of one frame member relative to the other. The locking method of this invention involves materials which are very compact and easy to use. It can easily be adapted for use on any conventional sashes.

In a preferred embodiment, the locking method of the invention is for selectively locking first and second frame members of a window or door to prevent sliding movement of one frame member relative to the other. The locking method comprises:

(a) providing an aperture in the first frame member;

(b) securing a sleeve member to the second frame member in a manner such that the aperture and the sleeve member are axially aligned;

(c) inserting a bolt system through the sleeve member; wherein the bolt system comprises (1) a first bolt member which is axially movable between extended and retracted positions; wherein the first bolt member includes first and second end portions; wherein the second end portion extends into the aperture when the first bolt member is in its extended position; and (2) a second bolt member including a connecting end portion and a head portion; wherein the connecting end portion is pivotably connected to the first end portion of the first bolt member; wherein when the first bolt member is in its retracted position the second bolt member may be pivoted relative to the first bolt member to a position generally perpendicular to the longitudinal axis of the first bolt member; and (d) providing bias means for biasing the first bolt member to its extended position.

When the second bolt member is urged outwardly from the first frame member the first bolt member is moved axially relative to the sleeve member to its retracted position. When the first bolt member is in its retracted position the second bolt member may be pivoted relative to the first bolt member to a position generally perpendicular to the longitudinal axis of the first bolt member, wherein the first bolt member is retained in its retracted position. The connecting end portion of the second bolt member may include a tapered and reduced diameter end which includes an elongated slot, whereby the second bolt member may be moved along a line generally perpendicular to the longitudinal axis of the first bolt member to further secure the first bolt member in its retracted position. When the first bolt member is in its retracted position, frames 11 and 13 may slide past each other (i.e., they are in unlocked condition).

The locking method of the invention does not require any external hardware to be attached to the frame members. As a result, the materials described for use in this invention can be used in connection with any conventional frames.

Other advantages of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
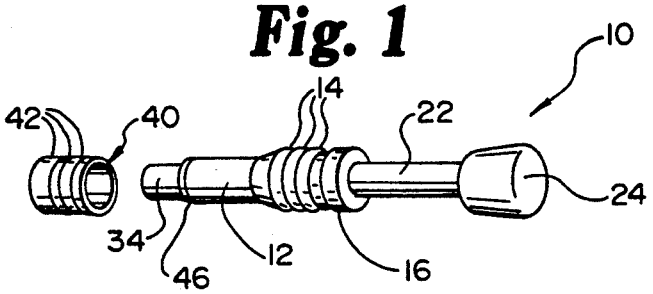
FIG. 1 is a perspective view of a preferred locking system used in this invention.
Figure 2:
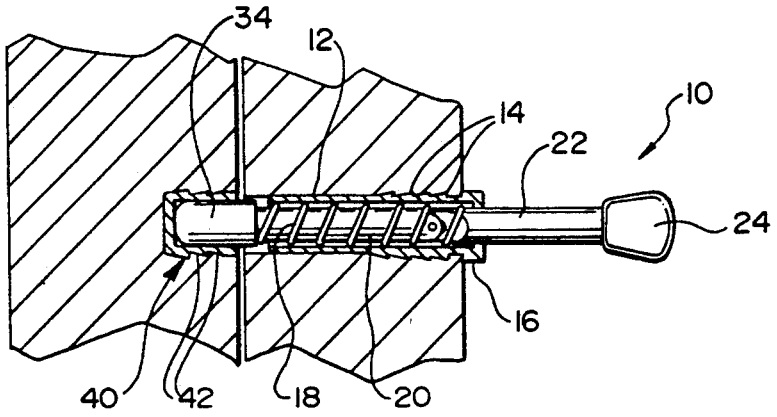
FIG. 2 is a cut-away view illustrating a locking system useful in this invention.
Figure 3:
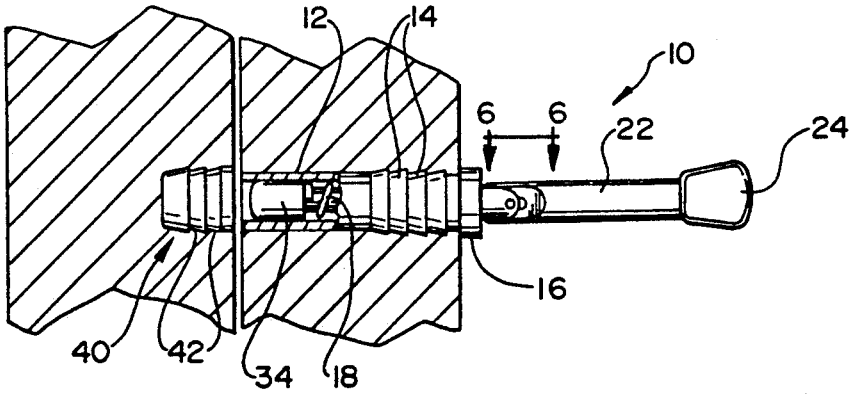
FIG. 3 is a side elevational, partially cut-away, view illustrating the bolt in retracted position.

In the drawings there is shown a preferred locking system 10 useful in this invention which comprises a first bolt 20 pivotably connected to a second bolt 22 and supported within an elongated sleeve member 12. The sleeve 12 is carried by one of the frame members 13.

A socket or recessed cup 40 is fitted into an aperture in the other frame member 11 in axial alignment with the sleeve in frame member 13, as shown. The exterior surface of the socket 40 preferably includes flutes 42 to facilitate anchoring in the aperture in frame member 11. The exterior surface of the sleeve 12 also preferably include flutes 14 to facilitate anchoring of the sleeve n the frame member 13.

Figure 4:
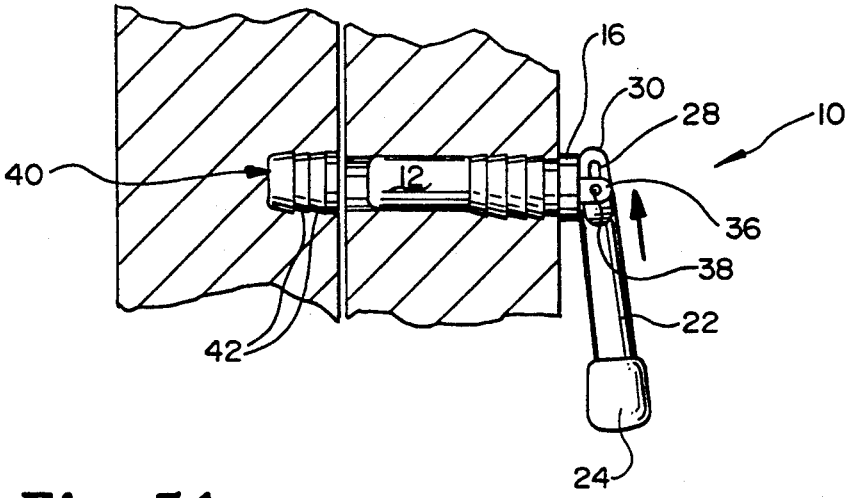
FIG. 4 is a side elevational, partially cut-away, view illustrating the bolt in retracted and locked position.
Figure 5A:
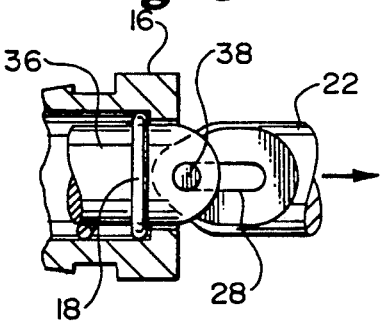
FIGS. 5A–5D are side elevational views showing a preferred manner for connecting the two bolt members used in the method of this invention.
Figure 5B:
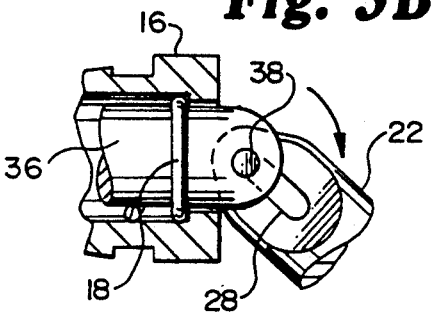
Figure 5C:
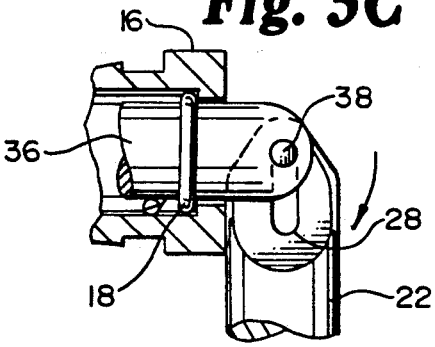
Figure 5D:
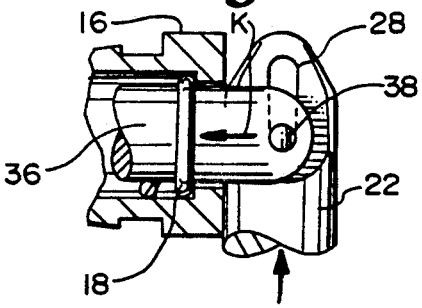
Figure 6:
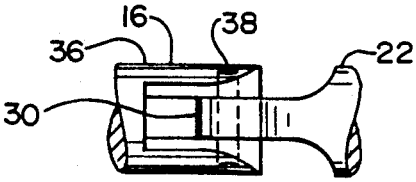
FIG. 6 is a top view showing the connection between the two bolt members.

The bolt members are pivotably connected to each other end-to-end fashion as shown in FIGS. 5A-5D and FIG. 6. Bolt 22 includes a tapered and reduced diameter end 30 having an elongated slot 28 extending therethrough. The connecting end 36 of bolt member 20 includes a yoke or U-shaped portion which is pivotably connected to the tapered end 30 of bolt 22 by means of pin 38. This arrangement enables bolt 22 to be pivoted with respect to bolt 20 (when bolt 20 is in its retracted position), and it also enables bolt 22 to be moved in a direction generally perpendicular to the longitudinal axis of bolt 20 to thereby lock the bolt 20 in its retracted position. The direction of movement is shown by the arrow. End 30 of bolt 22 is preferably rounded, as shown to facilitate pivotal movement of bolt 22 without interference with end 16 of sleeve 12. This is illustrated in FIG. 4.

When bolt 22 is in axial alignment with bolt 20, both bolt members are urged in the direction of frame member 11 by means of spring means 18. Preferably the outer end of bolt 20 includes an enlarged end 34 which is sized to be slidably received in the socket or recess 40 when the two frame members are in proper alignment. One end of spring 18 bears against the enlarged head 34, and the other end of the spring bears against the end 16 of the sleeve 12, as shown. Thus, the spring urges bolt 20 to a normally-extended position where it is slidably received in socket or recess 40 in frame 11, unless bolt 20 has been locked in its retracted position as shown in FIG. 4. Enlarged end 24 on the outer end of bolt 22 facilitates gripping of the bolt 24 for movement thereof.

The sleeve 12 may be inserted into an appropriate aperture or opening provided in frame 13. One end 46 of sleeve 12 is preferably bevelled to facilitate insertion into an opening through frame 13.

The slot 28 in bolt 22 may be of any size so long as (a) bolt 22 may be pivoted to a position generally perpendicular to bolt 20, and (b) bolt 22 may be moved along a line generally perpendicular to the longitudinal axis of bolt 20 in a manner such that bolt 22 locks bolt 20 in its retracted position. The arrangement shown in FIG. 4 is preferred, i.e., bolt 22 bears against the outer end 16 of sleeve 12 to retain bolt 20 in its retracted position.

Figure 7:
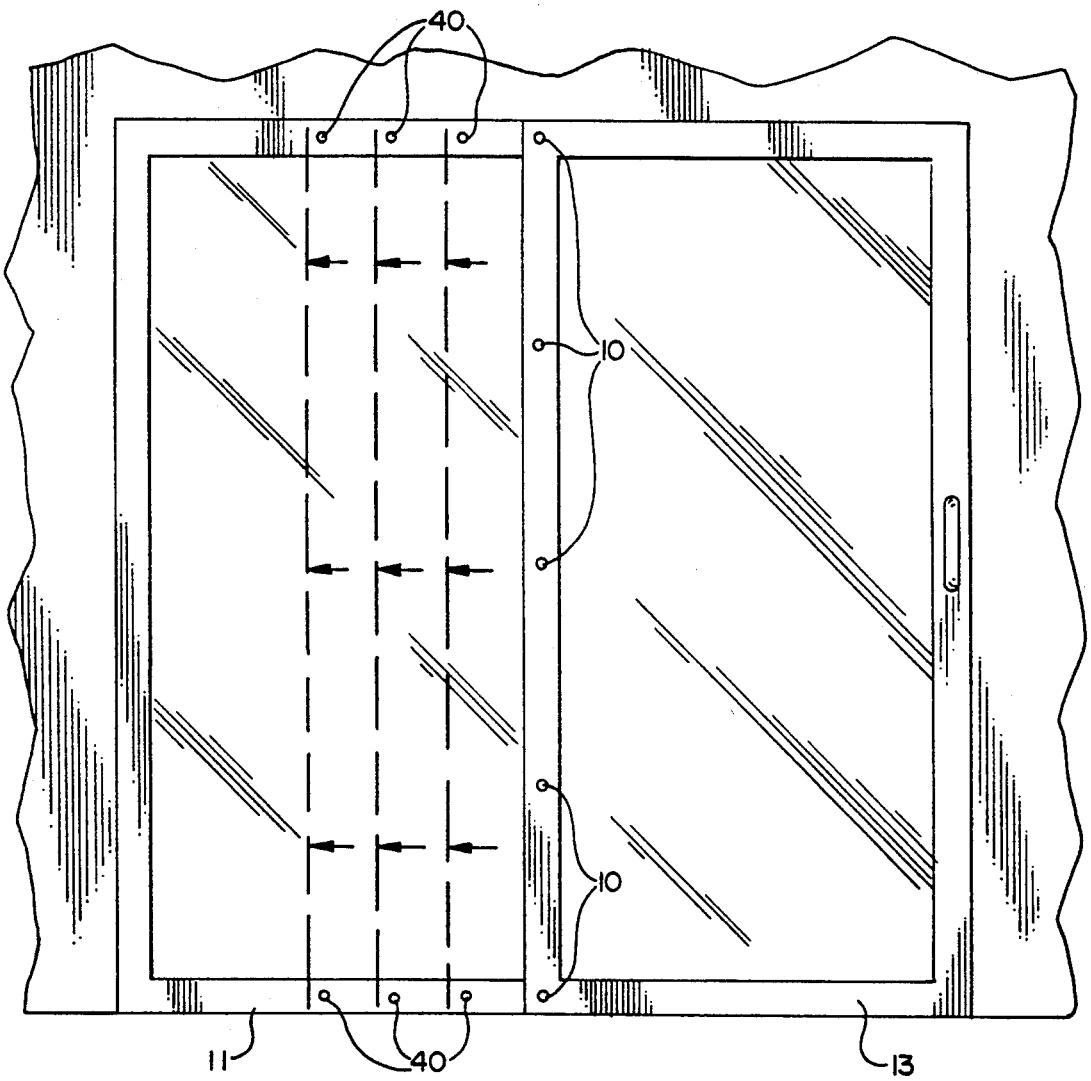
FIG. 7 shows a window frame including the locking system used in this invention.

Other variants are possible without departing from the scope of this invention. For example, as shown in FIG. 7 there may be a plurality of spaced sockets or recessed areas 40 in frame 11 so that frame 11 may be locked in any of a plurality of different positions relative to frame 13.

What is claimed is:

1. A method for selectively locking first and second frame members of a window or door to prevent sliding movement of one side frame member relative to the other; wherein the method comprises the steps of:

(a) providing an aperture in said first frame member;

(b) securing a sleeve member to said second frame member in a manner such that said aperture and said sleeve member are axially aligned;

(c) inserting a bolt system through said sleeve member, said bolt system comprising:

(i) a first bolt member which is axially movable between extended and retracted positions; wherein said first bolt members includes first and second end portions; wherein said second end portion extends into said aperture when said first bolt member is in said extended position; and (II) a second bolt member including a connecting end portion and a head portion; wherein said connecting end portion is pivotably connected to said first end portion of said first bolt member, and said connecting end portion of said second bolt member is received in said sleeve member when said first bolt member is in its extended position; wherein when said first bolt member is in said retracted position said second bolt member may be pivoted relative to said first bolt member and then moved along a line generally perpendicular to the longitudinal axis of said first bolt member; and (d) providing bias means for biasing said first bolt member to its said extended position.

2. A method for selectively locking first and second frame members of a window or door to prevent sliding movement on one side frame member relative to the other; wherein the method comprises the steps of:

(a) providing an aperture in said first frame member;

(b) securing a sleeve member to said second frame member in a manner such that said aperture and said sleeve member are axially aligned;

(c) inserting a bolt system through said sleeve member; wherein said bolt system comprises (1) a first bolt member which is axially movable between extended and retracted positions; wherein said first bolt member includes first and second end portions; wherein said second end portion extends into said aperture when said first bolt member is in said extended position; and (2) a second bolt member including a connecting end portion and a head portion; wherein said connecting end portion of said second bolt member includes an elongated slot;

(d) pivotally connecting said connecting end portion of said second bolt member to said first end portion of said first bolt member by means of pin means extending through said elongated slot; wherein when said first bolt member is in said retracted position said second bolt member may be pivoted relative to said first bolt member and the moved along a line generally perpendicular to the longitudinal axis of said first bolt member; and (e) providing bias means for biasing said first bolt member to its said extended position.

3. An improved method for locking first and second window or door frame members in a manner such that sliding movement of one of said frame member relative to the other said frame member is prevented, wherein said first frame member is prevented, wherein said first frame member includes an aperture therein for slidably receiving a bolt, and wherein said second frame member includes support means for said bolt, wherein the improvement comprises:

(a) inserting a bolt system through said sleeve member; wherein said bolt system comprises (1) a first bolt member which is axially movable between extended and retracted positions; wherein said first bolt member includes first and second end portions; wherein said second end portion extends into said aperture when said first bolt member is in said extended position; and (2) a second bolt member including a connecting end portion and a head portion; wherein said connecting end portion is pivotably connected to said first end portion of said first bolt member; wherein said connecting end portion of said second bolt member is received in said support means when said first bolt member is in its extended position; wherein when said first bolt member is in retracted position said second bolt member may be pivoted relative to said first bolt member and then moved along a line generally perpendicular to the longitudinal axis of said first bolt member; and (b) providing bias means for biasing said first bolt member to its said extended position.

4. An improved method for locking first and second window or door frame members in a manner such that sliding movement of one said frame member relative to the other said frame member is prevented, wherein said first frame member is prevented, wherein said first frame member includes an aperture therein for slidably receiving a bolt, and wherein said second frame member includes support means for said bolt, wherein the improvement comprises:

(a) inserting a bolt system through said sleeve member; wherein said bolt system comprises (1) a first bolt member which is axially movable between extended and retracted positions; wherein said first bolt member includes first and second end portions; wherein said second end portion extends into said aperture when said first bolt member is in said extended position; and (2) a second bolt member including a connecting end portion and a head portion; wherein said connecting end portion of said second bolt member includes an elongated slot;

(b) pivotally connecting said connecting end portion of said second bolt member to said first end portion of said first bolt member by means of pin means extending through said elongated slot; wherein when said first bolt member is in retracted position said second bolt member may be pivoted relative to said first bolt member and then moved along a line generally perpendicular to the longitudinal axis of said first bolt member; and (c) providing bias means for biasing said first bolt member to its said extended position.

* * * * *